United States Patent [19]

Etchell et al.

[11] 4,313,378

[45] Feb. 2, 1982

[54] NO-LOCK PRINTING PLATE ASSEMBLY USING FLEXIBLE PLATES

[75] Inventors: Gordon Etchell, Downers Grove; Cyril W. Frank, Brookfield, both of Ill.

[73] Assignee: Pathfinder Graphic Associates, Inc., Berwyn, Ill.

[21] Appl. No.: 188,935

[22] Filed: Sep. 19, 1980

Related U.S. Application Data

[63] Continuation-in-part of Ser. No. 115,101, Jan. 24, 1980, abandoned.

[51] Int. Cl.[3] ..... B41F 27/12

[52] U.S. Cl. ..... 101/415.1

[58] Field of Search ..... 101/415.1, 378; 51/368, 51/369

[56] References Cited

U.S. PATENT DOCUMENTS

| | | | |
|---|---|---|---|
| 2,621,592 | 12/1952 | Faeber | 101/415.1 |
| 2,900,904 | 8/1959 | Hantscho | 101/415.1 |
| 3,108,538 | 11/1963 | Barnes | 101/415.1 |

FOREIGN PATENT DOCUMENTS

| | | | |
|---|---|---|---|
| 1233893 | 6/1971 | United Kingdom | 101/415.1 |

*Primary Examiner*—Clifford D. Crowder

*Assistant Examiner*—D. J. Isabella

*Attorney, Agent, or Firm*—Leydig, Voit, Osann, Mayer & Holt, Ltd.

[57] ABSTRACT

A "no-lock" printing plate assembly including a plate cylinder having a smooth plate-supporting surface interrupted by an axial groove defining leading and trailing edges, at least the leading edge having a flat undercut end face with a register pin anchored therein. The plate is formed of a thin sheet of resilient material having a smooth undersurface and which is bent over adjacent its ends to define leading and trailing edge portions having respective longitudinal notches, the bend adjacent the leading edge making an acute angle and the bend adjacent the trailing edge making a wide obtuse angle. The width of the gap is substantially greater than twice the plate thickness and the edge portions of the plate are spaced and dimensioned so that when the plate is installed the bends are peripherally spaced from one another to provide clearance between them. The trailing edge portion of the plate is outwardly sprung causing the trailing edge of the plate to be in pressing engagement with the leading edge portion. "Ironing" of the plate by a cooperating cylinder results in the taking up of at least a portion of the clearance between the bends and cyclically renews a vacuum seal under the plate tending to hold the plate in position notwithstanding the effect of centrifugal force.

8 Claims, 10 Drawing Figures

NO-LOCK PRINTING PLATE ASSEMBLY USING FLEXIBLE PLATES

This is a continuation-in-part of application Ser. No. 115,101 filed Jan. 24, 1980, now abandoned.

Letter press printing is usually done by cast stereotype plates which are retained in place on the cylinder using heavy duty manually-operated lock-up mechanisms which engage the underside of the plate. In lithographic printing a thin flexible plate is used but it is the common practice to employ manually operated lock-up mechanisms for affirmatively gripping, tensioning and registering the plate on the cylinder. Such lock-up mechanisms take up considerable space, being arranged back-to-back in a necessarily wide groove which intersects the surface of the cylinder, the groove forming a "gap" representing non-printing area. Where the lithographic press is of the web fed type the gap results in wasteage of paper stock. Even where the lithographic press is of the sheet-fed variety, the gap is a nuisance to be contended with.

It has been proposed in British Pat. No. 1,233,893 that, in a press intended for lithographic printing, lock-up mechanisms may be dispensed with and that an undercut groove may be provided in the surface of the cylinder, and of twice the plate thickness, to receive the leading and trailing edges in a bottomed condition.

While the apparatus disclosed in the British patent appears attractive in theory, it does not work in practice. Employing a groove of twice the plate thickness requires that the bends at the leading and trailing edges of the plate be in contact with one another when the plate is installed. This does not account for the slight apparent "lengthening" of the plate as the plate is ironed into intimate contact with the surface of the plate cylinder during the first few revolutions with the blanket cylinder. With the end portions of the plate bottomed in the receiving groove there is no place for the trailing edge of the plate to go in response to the ironing action. Moreover, using the British system, with its lack of peripheral clearance between the bends at the edges of the plate, such bends must be imparted to the plate with a high degree of positional accuracy; in short, the bends must be positioned with "zero tolerance".

Finally, in the British patent it is taught that only one of the locating holes in each plate is cut into a slot opening from the leading edge of the plate, and the patent is silent as to registration of the trailing edge.

It is, accordingly, an object of the present invention to provide a no-lock printing plate assembly for thin flexible printing plates which dispenses with the usual mechanical lock-up, which provides secure retention and which overcomes the disadvantages of the structure set forth in the above British patent. Specifically it is an object of the invention to provide a no-lock plate assembly which is capable of accommodating the apparent lengthening of the plate which occurs as the plate is "ironed" into seated position.

It is, more specifically, an object of the present invention to provide a no-lock plate assembly which avoids the wide gaps required where conventional locking mechanisms are used but nevertheless employs a gap which is sufficiently wide so as to enable peripheral clearance between the bends at the ends of the plate when the plate is installed which not only enables accommodation of plate "lengthening" but also makes it unnecessary to adhere to close tolerances in spacing the bends at the ends of the plate from one another.

It is another object of the present invention to provide a no-lock plate assembly in which the obtuse bend which defines the trailing edge portion of the plate is made at a sufficiently wide angle so that the trailing edge of the plate is outwardly pre-sprung, with the result that the trailing edge of the plate presses upon the leading edge portion insuring that the leading edge portion is maintained in its registered and captive position.

It is another object to provide a no-lock printing plate assembly in which the plate, at both of its leading and trailing edges, is notched to receive the same register pin and which operates efficiently in both directions of rotation.

It is still another object of the invention to provide a no-lock printing plate assembly in which the outer surface of the cylinder is in the form of a saddle secured to the cylinder body and which carries the plate retaining and registering elements.

It is still another object of the invention to provide a no-lock printing plate assembly in which the plate, in addition to being held at its ends, is adhered to the surface of the cylinder by a cyclically renewed vacuum thereby further insuring that the plate is retained in spite of centrifugal force tending to dislodge it.

It is a general object of the invention to provide a no-lock printing plate assembly of the type employing a thin flexible plate which has wide utility, being usable in both lithograph presses and letter presses of either the sheet-fed or web-fed types.

Other objects and advantages of the invention will become apparent upon reading the attached detailed description and upon reference to the drawings in which.

While the invention has been described in connection with certain preferred embodiments of the invention it will be understood that we do not intend to be limited to the particular embodiments shown but intend to cover the various alternative and equivalent constructions included within the spirit and scope of the appended claims.

Figure 1:
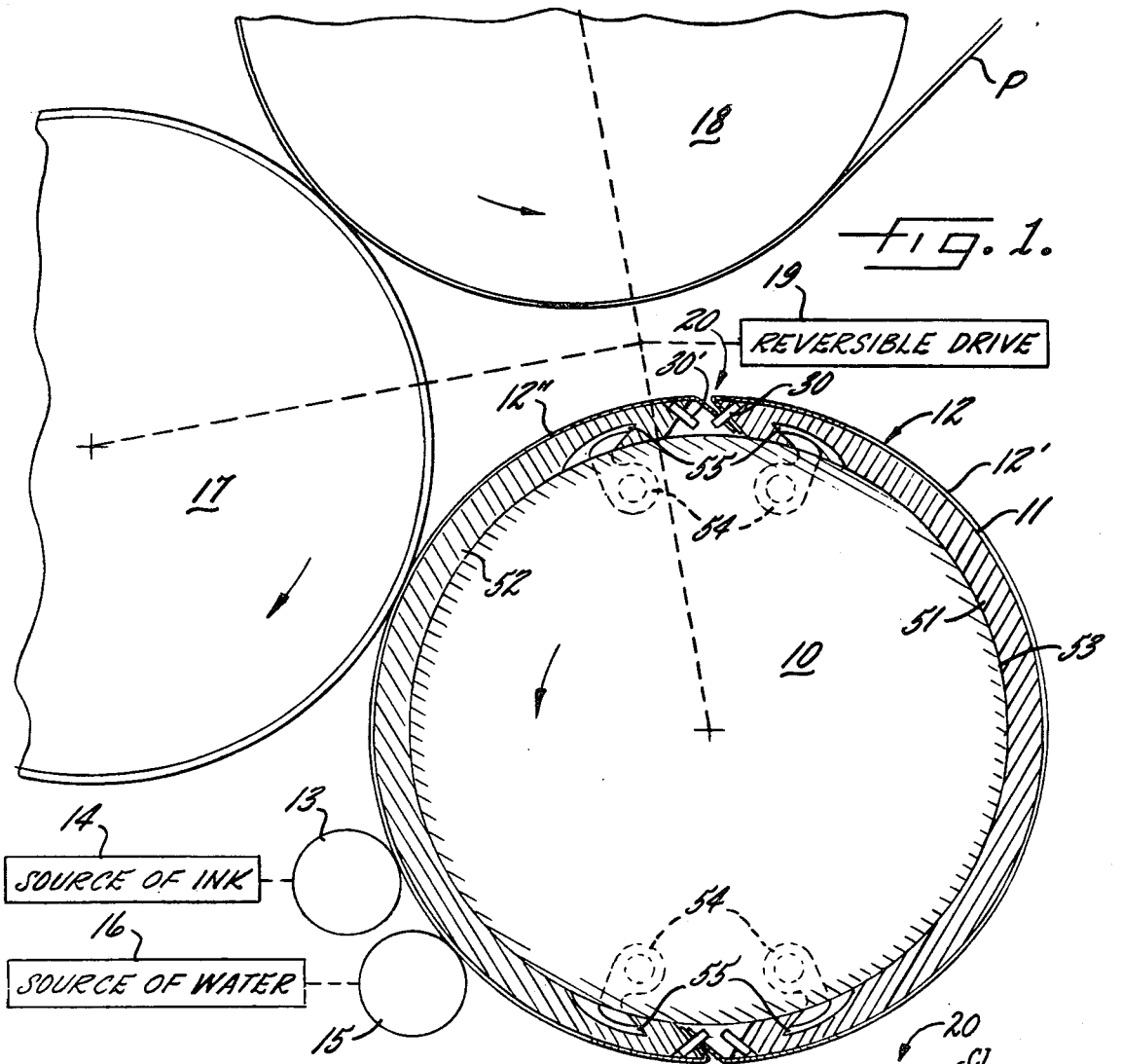
FIG. 1 shows the invention applied to a web-fed lithograph press including a plate cylinder, a blanket cylinder and impression cylinder.

Turning now to FIG. 1 there is shown a printing cylinder 10 providing a cylindrical plate-supporting surface 11 carrying a plate 12 made of flexible material. The plate, in this embodiment, is of the lithographic type in rolling engagement with an ink form roller 13 having a source of ink 14, as well as a water form roller 15 coupled to a source of water 16, both well understood in the art.

In running engagement with the inked and moistened plate is a blanket cylinder 17 surfaced with a resilient blanket which takes the inked image from the surface of the plate transferring, or offsetting, it onto a web of paper P which is supported upon an impression cylinder 18. All three of the cylinders 10, 17, 18, and elements of the ink and water supply systems as well, are coupled to a reversible press drive mechanism indicated generally at 19.

In carrying out the invention the cylindrical supporting surface 11 is interrupted by an axial groove 20 defining axially extending leading and trailing edges 21, 22 (see FIG. 3) spaced parallel to one another. At least the leading edge 21 has a flat cut end face 23 which makes an acute included angle with respect to the outer surface 11, an angle which is preferably on the order of 45 to 53 degrees.

For purposes of register a register pin is rigidly anchored in the end face 23 projecting circumferentially therefrom, that is, in a plane which is transverse to the cylinder axis. The pin, indicated at 30, is snugly fitted in a bore 31 which, as shown, is in communication with the plate supporting surface 11 permitting installation of the pin from the direction of the supporting surface. The unoccupied space at the contained outer end of the pin is preferably plugged so as to restore the integrity of the surface.

Further in the practice of the invention the plate, indicated at 12, is formed of a thin sheet of resilient material having a central, or printing, portion 40 and bent over adjacent the ends to define leading and trailing edge portions 41, 42. The leading and trailing edge portions have respective alined notches 43, 44 of the same axial width as the pin. The bend adjacent the leading edge of the plate, indicated at 45, is in the form of a crease making a sharp acute angle, so that when the leading edge portion 41 of the plate is hooked over the leading edge 21, it engages the undercut end face 23 with the notch 43 in both circumferential and axial register with the end face and the pin.

Figure 3:
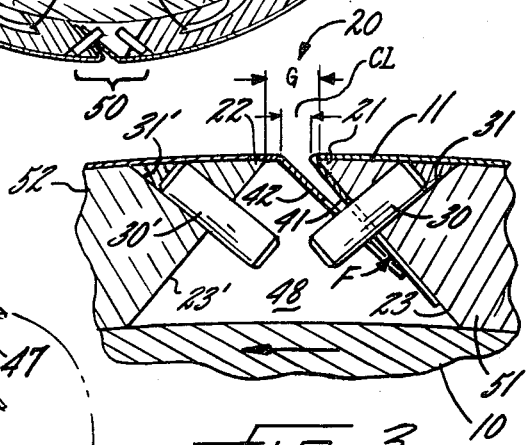
FIG. 3 is an enlarged cross sectional view based upon FIG. 1 showing the leading and trailing edge portions of the plate in seated condition.
Figure 4:
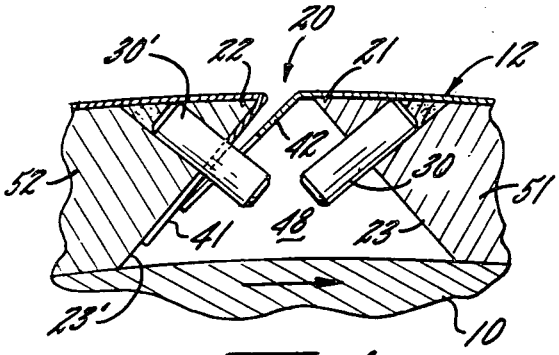
FIG. 4 is a view similar to FIG. 3 but showing the plate mounted for rotation in the opposite direction.

In accordance with the invention the gap G is made substantially greater than twice the plate thickness and the edge portions of the plate are spaced and dimensioned for insertion successively into the groove into a non-bottoming condition into which the bends are preferably spaced from one another to provide clearance between them, such clearance being indicated at CL in FIG. 3. The trailing edge portion of the plate is, moreover, outwardly "sprung" so that it presses the leading edge portion 41 of the plate in the direction of the end face 23 with a force F (FIG. 3) thereby insuring that the leading edge of the plate is maintained in its bent and seated condition. The trailing edge portion of the plate is thus not only registered by the same pin 30 which registers the leading portion but it actively serves to keep the leading edge portion 41 of the plate in its axially registered condition. The fact that the edge portion 42 is bent through only a shallow angle for outward springing insures that the trailing edge portion will engage at the register pin even though the pin is quite short.

By providing a gap G which is at least five times the thickness of the plate, but preferably not exceeding fifty times the thickness, and by spacing the bends 45, 46 to provide a clearance CL, a number of advantages are achieved. In the first place the slight apparent elongation of the plate as it is "ironed" onto the cylinder is accommodated by the taking up of a portion of the clearance and the bends may be formed without adhering to a high order of accuracy in the spacing between them. It is, moreover, one of the features of the present invention that the plate is so tailored that the extreme edges thereof fall short of bottoming in the receiving groove, thereby providing the trailing edge of the plate with some place to go as the plate is ironed into its final seated position.

Further in accordance with the invention the undersurface of the plate is intentionally smooth and in face-to-face contact with the supporting surface 11 so that when the blanket cylinder engages the plate there is formed, under the plate, a cyclically renewed vacuum seal tending to hold the plate in its seated position notwithstanding the effect of centrifugal force tending to dislodge it. Such vacuum seal is enhanced by the presence of casual liquid generally present at the surfaces as for example ink, oils, water, residual cleaning solution or the like.

Thus it will be understood by one skilled in the art that for the plate to leave its supporting surface it is necessary for air to get under it. In the absence of air there is an effective vacuum tending to hold the plate in place, a vacuum which is substantial and which approaches fourteen pounds for each square inch of plate area. As a result of the combination of the retention of the plate at its ends, described above, and the vacuum, plates secured by the present "no-lock" system may be operated at even the highest press speeds without risk of dislodgement.

In accordance with one of the features of the present invention the trailing edge 22 of the gap also has an associated flat angularly undercut end face having a register pin rigidly anchored in it and which is substantially a mirror image of the end face and register pin associated with the leading edge of the gap to secure a plate to the cylinder when the reversible drive 19 is reversed in direction. Thus the trailing edge 22 (FIG. 3) is provided with an end face 23' having a register pin 30' which is substantially identical to the pin 30 and which is alined with it. The end faces 23, 23' thus, together, define a groove which is symmetrically triangular in cross section. It is to be noted that only a single pin is used, in the present construction, to register both ends of the plate and where a separate pin is employed for reverse operation they both occupy centered positions alined with the same transverse plane, which makes it possible for a plate to be reversed, end for end, while maintaining its condition of register for either direction of cylinder rotation.

The invention has been described thus far in terms of a unitary plate 12 having two ends adjacent one another. However, the invention is not limited thereto and is equally applicable to plates arranged two, three, or even four "around". Indeed, FIG. 1 illustrates a preferred "two around" installation in which the plate 12 may be considered to have two "sections" 12' and 12'' of equal arcuate length joined by the cylinder, and effectively forming a continuation of one another, by using a second retaining assembly indicated at 50 (FIG. 1). Such assembly may in all respects be identical to that which has just been described.

Figure 8:
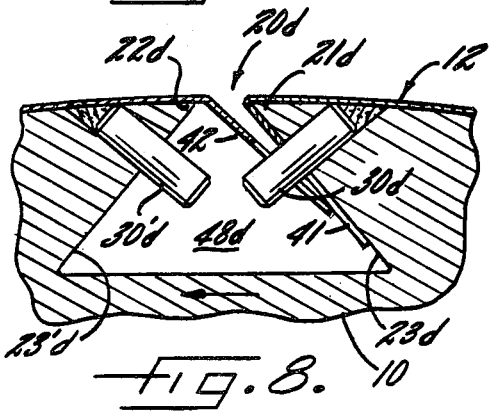
FIG. 8 shows a construction similar to FIG. 4 in which the undercuts are formed directly in the cylinder body.
Figure 9:
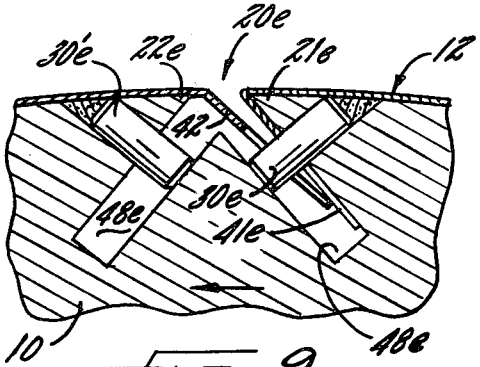
FIG. 9 shows a construction similar to FIG. 3 in which the undercuts are in the form of kerfs cut directly into the cylinder body.

Also the invention has been described above as though the plate-supporting surface 11 were formed directly upon the cylinder which is, indeed, a practical alternative which has been further illustrated in FIGS. 8 and 9 to be described. It is preferred, however, to interpose between the cylinder body and the plate a saddle which presents the undercut end faces and in which the register pins are mounted. Such saddle may extend "one-around" the cylinder body in single tubular fashion, or the saddle may be provided in adjacent arcuate sections, either two, three or four "around" corresponding to the sections of the printing plate. In FIG. 1 the invention has been illustrated in connection with a preferred arrangement employing a saddle in two arcuate sections which have been indicated at 51, 52, respectively, seated on the surface 53 of the cylinder body 10, with the saddles being secured to the cylinder body by means of a conventional tension lock-up of the type employed with stereotype plates.

Thus the tension lock-up, while not shown in detail, may include a series of hooks 54 recessed in the cylinder body and engaging pockets 55 at the ends of the saddles. The saddles 51, 52 are preferably molded, using a cored-out construction, of a relatively light weight durable plastic material having stable dimensional characteristics in the face of fluids such as water, ink, oil or liquid solutions of acids, alkalis or detergent which are generally present, in casual amounts, in a printing press environment. A plastic material meeting the requirements is commonly available under the trade name "Delrin" available from E. I. DuPont de Nemours & Co. of Wilmington, Del.

Figure 5:
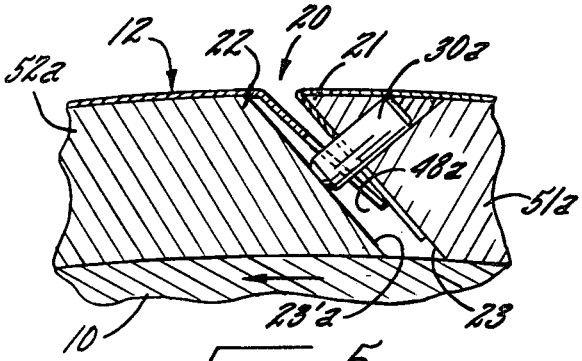
FIG. 5 shows a modification of the construction in which the end portions of the plate are received in a narrow kerf.

The radial dimension of the blanket should, in all cases, be such as to cause the outer diameter of the installed plate to be equal to the outer diameter of the blanket and impression cylinders, assuming that all of the cylinders are driven, as is conventional, at the same rotative speed.

Where only unidirectional rotation of the printing cylinder is required it is possible to use a somewhat simplified arrangement as shown in FIG. 5. In this modification, in which similar elements are represented by similar reference numerals with addition of subscript "a", the undercut end face 23 at the leading edge of the saddle 51 is formed of a kerf having side walls parallel to one another. The plate 12 in all respects remains the same as the plate previously described, and its register pin, indicated at 30*a*, is also the same. In this connection the pin 30*a* extends bridgingly, all of the way across the chamber 48*a*. The operation, features and advantages, except for reversibility, are the same as those previously described.

It is one of the features of the present invention that the included angle of the undercut end face 23, previously stated to be on the order of 45–53 degrees may be less acute without substantial sacrifice of holding ability. This is llustrated in FIG. 6 where similar elements have been indicated by similar reference numerals with addition of subscript "b". The angle here shown as about 83 degrees could be as great as 89 degrees without departing from the invention. The register pin, indicated at 30*b*, not only bridges the space 48*b*, but the tip of the pin is recessed in a registering notch 60 or clearance hole formed at the trailing edge of the saddle 52*b*.

Figure 7:
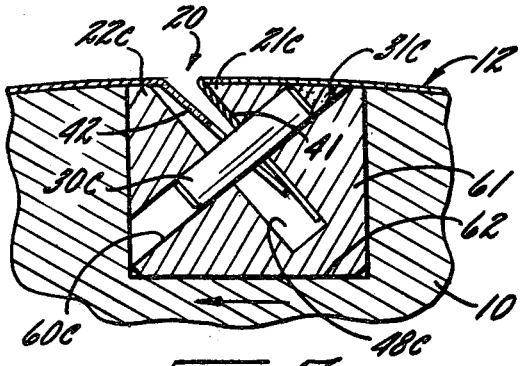
FIG. 7 is a fragmentary elevation showing the kerf formed in an insert which is flush with the cylinder surface.

In accordance with one of the aspects of the present invention a cylinder may be provided with a longitudinally extending insert securely fitted into a mating longitudinal recess, the insert being flush with the cylinder surface and with the undercut end face being formed by a kerf in the insert with a pin mounted therein bridging position. Such an arrangement is illustrated in FIG. 7 in which the insert, shown at 61, is fitted into a longitudinal recess 62. The other no-lock elements carry reference numerals corresponding to the earlier embodiments with addition of subscript "c". Thus a pin 30*c* mounted in a bore 31*c* in the insert extends bridgingly across the kerf 48*c* with its tip being received in a recess 60*c* on the opposite side. The plate 12 and its mode of retention are the same as described in connection with FIGS. 3 and 5.

It has already been stated that, within the scope of the invention, the saddle, while an important part of the invention, is not essential and that the undercut groove may be formed directly within the cylinder body, provided that the latter is of appropriate diameter. Such an arrangement is shown specifically in FIG. 8 where similar elements have been represented by similar reference numerals with addition of subscript "d". It will be immediately recognized that this view corresponds closely to FIG. 3 employing register pin 30*d* as the active pin, engaging the notches in the bentover end portions 41, 42 of the plate 12, which remains the same.

Alternatively, instead of providing a relatively large internal chamber of substantially triangular shape as shown at 48*d* in FIG. 8, separate kerfs arranged substantially at right angles to one another and merging at the cylinder surface may be used. Referring to FIG. 9, in which similar elements are indicated by similar reference numerals with addition of subscript "e", a pair of perpendicularly related kerfs 48*e* house separate reference pins indicated at 30*e*, 30′*e*, respectively. The separate kerfs are utilized in the opposite directions of rotation. The mode of retention and the features and advantages of the construction correspond to those described in connection with FIG. 3.

Figure 2:
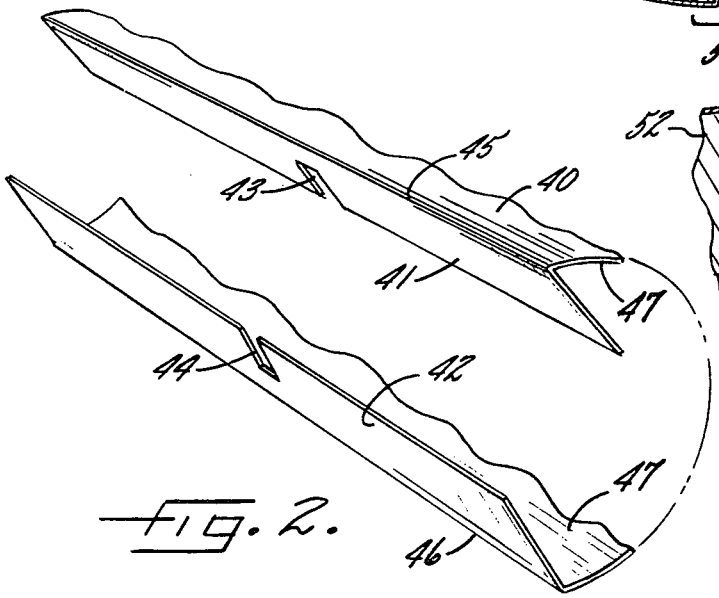
FIG. 2 is a fragmentary perspective showing the leading and trailing edge portions of a flexible plate.

The term "bent-over edge portion" has been applied to both the portion 41 at the leading edge and the portion 42 at the trailing edge of the plate. The bend 45 adjacent the leading edge of the plate is preferably in the form of a sharp and intentional crease making an acute angle, this bend being imparted to the plate prior to installation. In the case of the bend 46 (FIG. 2) adjacent the trailing edge, this bend is in the form of a wide obtuse angle. It is preferred that this bend be made just as in the case of the bend 45, before the plate is installed, but because of the shallow nature of the bend, which is widely obtuse, the bend may be simply that which occurs incident to installation of the plate, thereby to provide a greater degree of "springing" of the trailing end portion 42 against the leading edge portion 41.

It has been stated as one of the features of the invention that the plate-supporting surface 11 and the underside of the plate indicated at 47 (FIG. 2) are both smooth surfaces developing a vacuum seal between them. By the term "smooth" as used herein is meant that the surfaces are sufficiently free of intentional patterning or interruption so as to preclude entry of any appreciable amount of air between the plate and its supporting surface during a revolution at operating speed, that is to say, in the period between successive engagements of each portion of the plate by the cooperating cylinder 17 which performs a repeated "ironing" and tensioning function.

By the term "flat" used herein as applied to the angularly undercut end face 23, is meant that such end face is sufficiently planar over at least a portion of its area to present an area generally parallel to the leading edge portion of the plate as such leading edge portion is held in captive position. The term "pin" as used herein is not limited to a cylindrical element but includes any projection employed for register purposes having parallel axially presented side walls.

By reason of the above invention, installation of a flexible printing plate can be accomplished in a fraction of the time required for more conventional manually operated lock-up devices: the bent-over leading edge portion of the plate is simply hooked over the leading edge of the cylinder (or saddle, if present), with the leading edge notch in snug axial engagement with the register pin. In a plate which is "one around" the trailing edge portion of the plate is simply tucked into the same groove so that it extends in the direction of the register pin with the notch therein in register with the same pin and with the trailing edge portion of the plate in an outwardly sprung condition to press upon the leading edge portion, thereby to insure that it is maintained in its bent condition. At this point the plate will not be tight; however, the "ironing" action of the blanket cylinder rolling in contact with the plate during successive revolutions causes the smooth undersurface of the plate to be pressed into increasingly intimate engagement with the smooth outer plate supporting surface of the cylinder to establish the periodically renewed vacuum seal already mentioned.

Where the plate 12 is in two sections, "two around", installation is just as easy: one of the two plate sections may be completely installed. When installing the second, the bent-over leading edge portion of the second plate is simply tucked into the groove between the trailing edge portion of the first section and the hooked undercut surface 23. The outwardly sprung trailing edge portion indeed serves as an inclined guide surface for guiding the leading edge portion of the second section into its position of registered seating. For removal the above steps are simply reversed.

Figure 6:
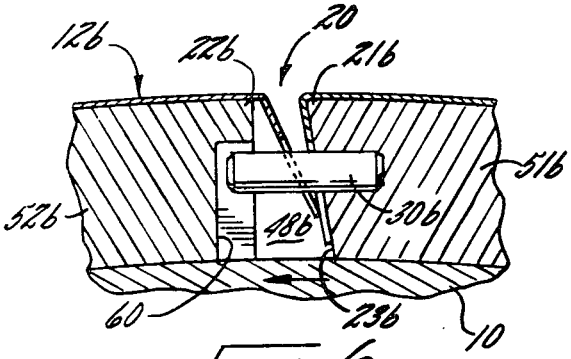
FIG. 6 shows a construction similar to FIG. 5 but in which the angle of the end face is less acute.
Figure 10:
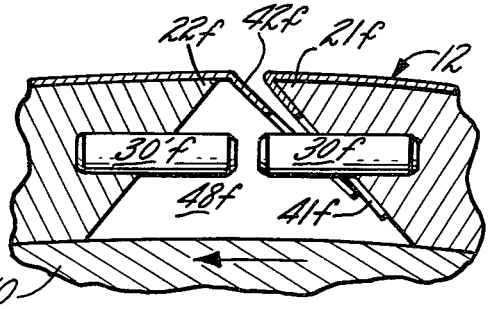
FIG. 10 is a view similar to FIG. 3, but showing a modified pin mount.

In considering the above embodiments it will be noted that a register pin may be mounted in tangential position as shown in FIG. 6 or in angled position as set forth in the rest of the figures discussed above. In the case of a removable saddle it is, indeed, preferred to practice the invention using pins which are tangentially oriented. It will thus be apparent that the structure shown in FIG. 3 may be readily modified to employ tangentially arranged pins as illustrated in FIG. 10 where corresponding reference numerals are used to indicate corresponding parts, with addition of subscript "f". This has the advantage of improved strength while preserving the cylindrical surface intact and free of any necessity to provide "filler".

While the invention has been described in connection with use of a flexible plate on a lithograph press, it will be apparent that the invention is not limited to such a press and that the invention is applicable wherever a thin flexible printing plate is to be secured on a cylinder in a peripherally and axially registered condition with minimal gap.

In accordance with one of the more detailed aspects of the present invention the present "no-lock" system may be applied, on a retrofit basis, to cylinders having conventional lock-up devices mounted in deep longitudinal grooves of rectangular cross section spaced about the cylinder surface. In a typical "conversion" a groove is first cleared of all prior lock-up elements and then an insert 61 of rectangular configuration conforming to the groove cross section, and provided with an angular kerf and register pin (see FIG. 7), is fitted into the groove. The insert is retained seated in the groove, against the effects of centrifugal force, by one of two means. The insert may be radially bored, with deep countersink, for accommodating a series of machine screws which are threadable into holes in the root of the groove. Alternatively, the ends of the groove may be enclosed by bridges which extend chordwise at the respective ends of the cylinder, the insert being secured, at its ends, to such bridges by bolts extending inwardly into the insert at each of its ends.

What we claim is:

1. A "no-lock" printing plate assembly comprising, in combination, a drive, a plate cylinder coupled to the drive and having a smooth outer plate-supporting surface interrupted by an axial groove defining leading and trailing edges spaced parallel to one another to form a gap, at least the leading edge having an associated flat, angularly undercut end face making an acute angle with respect to the outer surface, a register pin rigidly anchored with respect to the undercut end face and projecting in the circumferential direction therefrom, a plate formed of a thin sheet of resilient material having a smooth undersurface and bent over adjacent the ends to define leading and trailing edge portions, the width of the gap being at least 5 times but not greater than 50 times the plate thickness, the edge portions of the plate being spaced and dimensioned for insertion successively into the groove into a non-bottoming condition in which the bends are peripherally spaced from one another to provide clearance between them, both the leading and trailing edge portions having respective longitudinal notches alined with one another and of the same axial width as the pin for purposes of register, the bend adjacent the leading edge being in the form of a sharply bent crease making an acute angle so that when the leading edge portion is hooked over the leading edge in circumferential register it engages the undercut end face with the notch therein in axial register with the pin, the bend adjacent the trailing edge of the plate being in the form of an obtuse angle so that when the trailing edge portion of the plate is tucked into the groove it extends beyond the register pin with the notch therein in axial register with the pin, the trailing edge portion of the plate being bent at a sufficiently wide obtuse angle so that it is outwardly sprung causing the trailing edge of the plate to be in continuous resilient pressing engagement upon the leading edge portion thereby to insure that the latter is maintained in sharply bent condition captive against the undercut end face, and at least a second cylinder in running engagement with the plate so that during the initial revolutions the smooth undersurface of the plate is "ironed" into increasingly intimate engagement with the smooth outer plate-supporting surface accompanied by the taking up of at least a portion of the clearance between the bends and cyclically renewing a vacuum seal under the plates tending to hold the plate in position notwithstanding the effect of centrifugal force tending to dislodge it.

2. The combination as claimed in claim 1 in which the trailing edge of the gap also has an associated flat angularly undercut end face having a register pin rigidly anchored with respect thereto and which is substantially a mirror image of the end face and register pin associated with the leading edge of the gap, the drive being reversible thereby to interchange the functions of the leading and trailing edges.

3. The combination as claimed in claim 1 in which the groove is symmetrically triangular in cross section including a pair of undercut end faces with register pins mounted in circumferentially alined positions in each of them, the drive being reversible thereby to interchange the functions of the leading and trailing edges of the groove.

4. A "no-lock" printing plate assembly comprising, in combination, a drive, a plate cylinder coupled to the drive, a saddle secured to the cylinder and having a smooth outer plate-supporting surface, the ends of the saddle being spaced from one another to define an axially extending groove forming a gap in the supporting surface defining leading and trailing edges on the saddle, at least the leading edge having an associated flat, angularly undercut end face making an acute angle with respect to the outer surface, a register pin rigidly anchored in the undercut end face and projecting in the circumferential direction therefrom, a plate formed of a thin sheet of resilient material having a smooth undersurface and bent over adjacent the ends to define leading and trailing edge portions, the width of the gap being at least 5 times but not greater than 50 times the plate thickness, the edge portions of the plate being spaced and dimensioned for insertion successively into the groove into a non-bottoming condition in which the bends are peripherally spaced from one another to provide clearance between them, both the leading and trailing edge portions having respective longitudinal notches alined with one another and of the same axial width as the pin for purposes of register, the bend adjacent the leading edge being in the form of a sharply bent crease making an acute angle so that when the leading edge portion is hooked over the leading edge in circumferential register it engages the undercut end face with the notch therein in axial register with the pin, the bend adjacent the trailing edge of the plate being in the form of an obtuse angle so that when the trailing edge portion of the plate is tucked into the groove it extends beyond the register pin with the notch therein in axial register with the pin, the trailing edge portion of the plate being bent at a sufficiently wide obtuse angle so that it is outwardly sprung causing the trailing edge of the plate to be in continuous resilient pressing engagement upon the leading edge portion thereby to insure that the latter is maintained in sharply bent condition captive against the undercut end face, and at least a second cylinder in running engagement with the plate so that during the initial revolutions the smooth undersurface of the plate is "ironed" into increasingly intimate engagement with the plate-supporting surface on the saddle accompanied by the taking up of at least a portion of the clearance between the bends and cyclically renewing a vacuum seal under the plate tending to hold the plate in position on the saddle notwithstanding the effect of centrifugal force tending to dislodge it.

5. The combination in claim 4 in which the trailing edge of the saddle also has an associated flat angularly undercut end face having a register pin rigidly anchored therein and which is substantially a mirror image of the end face and register pin associated with the leading edge of the saddle, the register pin being in circumferential alinement, the drive being reversible thereby to interchange the function of the leading and trailing edges.

6. The combination as claimed in claim 4 in which the groove is symmetrically triangular in cross section including a pair of undercut end faces with register pins mounted in circumferentially alined positions in each of them, the drive being reversible thereby to interchange the functions of the leading and the trailing edges of the groove.

7. The combination as claimed in claim 1 in which the plate cylinder has a mounting groove of rectangular cross section, the mounting groove being completely filled by a fitted insert of matching cross section, the insert extending the length of the cylinder, the axial groove forming the gap being formed in the insert, and means for retaining the insert in the mounting groove and secured to the cylinder against the effects of centrifugal force, the groove which forms the gap being itself in the form of a longitudinal kerf oriented at an angle to the radius of the cylinder and having spaced parallel side walls.

8. The combination as claimed in claim 1 or in claim 4 in which the notches respectively in the leading and trailing edge portions of the plate are axially centered therein for axial register engagement simultaneously with the same pin.

* * * * *